US006481713B2

(12) United States Patent
Perrie et al.

(10) Patent No.: US 6,481,713 B2
(45) **Date of Patent: *Nov. 19, 2002**

(54) POKER DICE CASINO GAME METHOD OF PLAY

(75) Inventors: Kenneth Allan Perrie, Groton, CT (US); Olaf Vancura, Las Vegas, NV (US)

(73) Assignee: Mikohn Gaming Corporation, Las Vegas, NV (US)

( * ) Notice: Subject to any disclaimer, the term of this patent is extended or adjusted under 35 U.S.C. 154(b) by 95 days.

This patent is subject to a terminal disclaimer.

(21) Appl. No.: 09/954,595

(22) Filed: Sep. 12, 2001

(65) Prior Publication Data

US 2002/0036380 A1 Mar. 28, 2002

Related U.S. Application Data

(62) Division of application No. 09/709,665, filed on Nov. 9, 2000, now Pat. No. 6,305,686, which is a continuation of application No. 09/218,506, filed on Dec. 22, 1998, now Pat. No. 6,173,955.

(60) Provisional application No. 60/068,625, filed on Dec. 23, 1997, and provisional application No. 60/078,348, filed on Mar. 17, 1998.

(51) Int. Cl.[7] ..... A63F 9/04

(52) U.S. Cl. ..... 273/146; 273/138; 273/142 R; 463/20

(58) Field of Search ..... 273/146, 138, 273/142 R; 463/20

(56) References Cited

U.S. PATENT DOCUMENTS

| | | | |
|---|---|---|---|
| 2,881,892 | A | 4/1959 | Ylinen |
| 3,592,473 | A | 7/1971 | Jernakoff et al. |
| 3,659,853 | A | 5/1972 | Church |

(List continued on next page.)

FOREIGN PATENT DOCUMENTS

| | | | |
|---|---|---|---|
| EP | 0 426 301 | A1 | 5/1991 |
| EP | 0 862 152 | A1 | 9/1998 |
| EP | 0 874 337 | A1 | 10/1998 |
| EP | 0 875 870 | A2 | 11/1998 |

OTHER PUBLICATIONS

Marshall Fey, Slot Machines, 1997, Reno, Nevada, p. 75.
John Scarne, Scarne's New Complete Guide to Gambling, 1974, Simon & Schuster, Inc., New York, New York, p. 532.
Yam, Internet, Jul. 23, 1998 (2 pages).
The Canadian Contingent Paintball Club—Liar's Dice Rules, Internet, Jul. 23, 1998, (2 pages).
Yahtzee Score Card, 1992, Milton Bradley Co.
Triple Yahtzee Instructions, 1982, Milton Bradley Company (4 pages).
Fey, Marshall, Slot Machines, 1997, p. 75, Liberty Belle, Reno, Nevada.

*Primary Examiner*—Benjamin H. Layno
*Assistant Examiner*—Dolores R. Collins
(74) *Attorney, Agent, or Firm*—Dorr, Carson, Sloan & Birney, P.C.

(57) ABSTRACT

A method for playing a stand-alone and a bonus casino poker dice having X dice, each of the X dice having F faces with a different symbol thereon so as to form a set {S} of symbols on each of the X dice. The method of the present invention includes the steps of placing a wager; rolling the dice; holding none, any, or all of the rolled dice; ending the casino poker dice game when the dice are all held or when re-rolling occurs Y times; paying any winning combinations of symbols based on the placed wager and in response to the step of ending the game; re-rolling the non-held dice when less than all the X dice are held; and repeating various of these steps until the game ends. Variations on this basic method are set forth for stand-alone games, bonus games, used in conjunction with underlying gaming machines, and playing a bonus game of the present invention in parallel with an underlying game so that a number of hands are played.

13 Claims, 7 Drawing Sheets

U.S. PATENT DOCUMENTS 3,709,499 A 1/1973 Lukens, Jr.
3,791,650 A 2/1974 Dice
4,431,189 A 2/1984 Wiencek et al.
4,506,890 A 3/1985 Murry
4,669,728 A 6/1987 Carden
4,858,931 A 8/1989 McKenchnie
4,909,513 A 3/1990 Kiyono
5,031,913 A 7/1991 Hirosumi et al.
5,031,914 A 7/1991 Rosenthal
5,259,616 A * 11/1993 Bergmann ..... 273/138 A
5,263,715 A 11/1993 Matsumoto et al.
5,344,145 A 9/1994 Chadwick et al.
5,362,052 A 11/1994 Kubatsch
5,456,467 A * 10/1995 Hoover ..... 273/146
5,556,101 A 9/1996 Jabro
5,573,248 A 11/1996 Parra et al.
5,630,586 A 5/1997 Lowden
5,775,692 A * 7/1998 Watts et al. ..... 273/143 R
5,791,649 A * 8/1998 DiSandro ..... 273/243
5,848,932 A * 12/1998 Adams ..... 463/20
5,890,962 A * 4/1999 Takemoto ..... 463/20
6,012,982 A * 1/2000 Piechowiak et al. ..... 463/16
6,173,955 B1 * 1/2001 Perrie et al. ..... 273/146
6,305,686 B1 * 10/2001 Perrie et al. ..... 273/146

* cited by examiner

POKER DICE CASINO GAME METHOD OF PLAY

RELATED APPLICATION

This application is a divisional of Ser. No. 09/709,665 filed Nov. 9, 2000 now U.S. Pat. No. 6,305,686 entitled "POKER DICE CASINO GAME METHOD OF PLAY," which is a continuation of Ser. No. 09/218,506 entitled "POKER DICE CASINO GAME METHOD OF PLAY," filed on Dec. 22, 1998, now U.S. Pat. No. 6,173,955 and which claims priority to the provisional applications entitled "POKER DICE GAME METHOD OF PLAY," Ser. No., 60/068,625 filed on Dec. 23, 1997 and Ser. No. 60/078,348 filed on Mar. 17, 1998.

BACKGROUND OF THE INVENTION

1. Field of the Invention

This invention relates to betting games suitable for casino play and, more particularly, to poker dice casino games.

2. Statement of the Problem

The game of poker is typically played with a single deck of cards. In Stud Poker variations, each player receives a predetermined number of unique cards. In Hold'em Poker variations, community cards are utilized. In Draw Poker variations, players are given the opportunity to replace their cards from the unused pack. Cards need not be the only device which provides the means for rank and suit. Dice, too, have this feature.

In conventional poker dice, five poker dice whose six sides bear playing-card denominations (i.e., ace, king, queen, jack, ten and nine) are used. However, conventional dice can also be used in poker dice with ace being high followed by the numbers six, five, four, three, and two in that order. The one number may or may not be wild. In conventional play, after the first throw of the five dice, a player may stand pat or may draw (as in Draw Poker) by throwing one, two, or three dice again. The object of poker dice is to secure any combination such as five-of-a-kind, four-of-a-kind, full house, straight, three-of-a-kind, two pair, one pair. Scarne's "New Complete Guide to Gambling" (1974).

Indeed, the popular game trademarked YAHTZEE by Hasbro, Inc. is basically a draw poker variation in which the players are allowed, twice, to "replace" existing rolls of five dice. Likewise, the casino games of Chuck-a-Luck and Sic Bo employ poker-like rankings with varying payoffs for obtaining one-, two-, or three-of-a-kind with a single roll of three dice. Likewise, the casino game of Craps refers to a pair occurring with the roll of two dice as "the hard way" and, for several wagers, differentiates this total from an "easy" one. Some commercial recreational game products assign various card values to the faces of six-sided dice. These are used, in conjunction with subsequent rolls, to construct a "poker hand."

A continuing need exists for new casino games and, in particular, for modifications and improvements to poker, dice, and poker dice that can be used for wagering, bonusing, and/or as a payoff dispensing mechanism. A continuing need exists to provide new and exciting bonus conditions for players of underlying games.

A further need exists to adopt the conventional home game of YAHTZEE, and other similar home games to a gaming environment such as is found in casinos. In conventional YAHTZEE games, a hand is assigned a score which is entered onto a pad of paper called a "score card" and all scores entered are similar in size. In the YAHTZEE game, a "small straight" box in the score card scores 30 points whenever four of the five rolled dice result in a sequence of four numbers. A "large straight" box is scored 40 points whenever all five of the rolled dice result in a sequence of five numbers. The YAHTZEE box is scored 50 points when the five rolled dice show "5 of a Kind." A "chance" box is scored when the player chooses to sum the values of the five dice together. In the YAHTZEE game, each player is allowed a maximum of three rolls although the player may stop after the first or second roll. For the second and third rolls, the player may selectively hold none, any or all the dice. A need exists in a corresponding casino game based on the YAHTZEE game to provide a broad range of payoffs from small to jackpot amounts. In conventional YAHTZEE games some scores are fixed (e.g., 30 points) and other scores are variable (e.g., sum of dice). A need exists in a corresponding casino game to simplify the scoring so as to eliminate any confusion especially for new players. In a YAHTZEE game one hand occurs quickly and a typical game of thirteen hands is lengthy. A need exists in a corresponding casino game to adapt the length of the game to be comparable to other conventional casino games. A conventional YAHTZEE game also requires skill by a player. A need exists in a corresponding casino game to play the game with no skill, but retain suspense and excitement. Finally, need exists to adopt a popular game such as YAHTZEE to a wagering game providing a fair house advantage to the casino.

SUMMARY OF THE INVENTION

1. Solution to the Problem. The present invention solves the above problems by providing (1) methods for wagering on and playing a poker dice game, (2) methods for providing bonusing games for underlying casino games, and (3) methods for dispensing payoffs.

The present invention also solves the above problems by providing a method for wagering on and playing a casino poker dice game either as a stand-alone game or as a bonus game for an underlying gaming machine. In a preferred method of play suitable for video adaptation as a bonus game for a gaming device, money, gaming chips, credits, or their equivalent may be wagered. Buttons, either on screen or adjacent to the monitor, are provided for players to indicate their choices. An executable computer software program, or a hardware equivalent such as an EPROM, brokers the casino game of the present invention according to the rules of play. A number of bonusing conditions initiate the bonus game of the present invention which can also be used to initiate other types of bonus games. In a second preferred method of play, a game table or a gaming machine is used to play the poker dice game as a stand-alone game.

The present invention, in part, adapts the conventional home game of YAHTZEE to the casino environment as a bonusing game in a variety of embodiments. The present invention differentiates hands and assigns payoff values in a broad range from minimal values to jackpot values. The payoff values provide clarity in that the payoff values are all fixed or all variable. The length of the casino game varies under different embodiments of the present invention. A one-hand version of the game is designed for players experienced in the standard YAHTZEE game. Another version of the game of the present invention is designed to play successive hands in order to avoid chance. And a third version of the game of the present invention provides a limited score card. Finally, the present invention provides a casino game in which no skill is involved, but which provides moves that build suspense and retain excitement.

2. Summary of the Invention. A method for playing a stand-alone and a bonus casino poker dice having X dice, each of the X dice having F faces with a different symbol thereon so as to form a set {S} of symbols on each of the X dice. The method of the present invention includes the steps of placing a wager; rolling the dice; holding none, any, or all of the rolled dice; ending the casino poker dice game when the dice are all held or when re-rolling occurs Y times; paying any winning combinations of symbols based on the placed wager and in response to the step of ending the game; re-rolling the non-held dice when less than all the X dice are held; and repeating various of these steps until the game ends. Variations on this basic method are set forth for stand-alone games, bonus games used in conjunction with underlying gaming machines or games, and playing a bonus game of the present invention in parallel with an underlying game so that a number of hands are played.

DETAILED DESCRIPTION OF THE INVENTION

Figure 1:
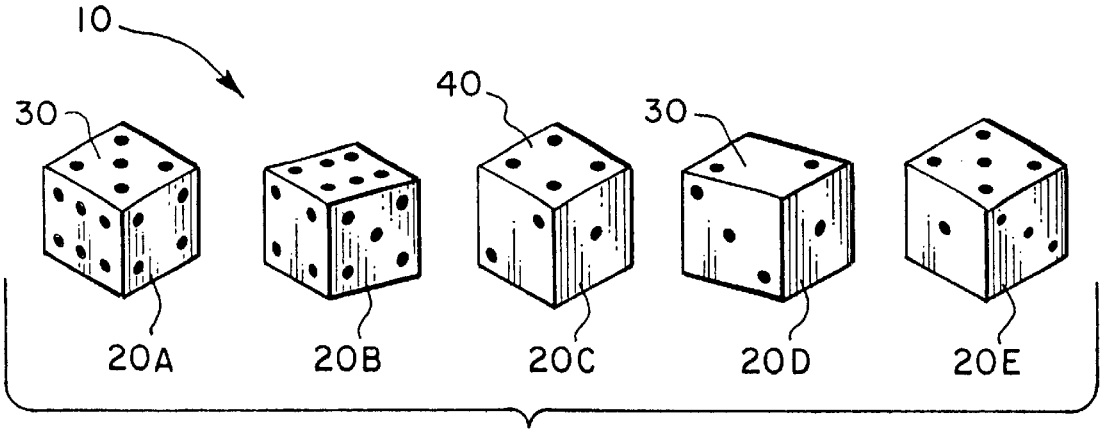
Fig. 1 ( Prior Art )
FIG. 1 illustrates one embodiment of the prior art dice used in the poker dice game of the present invention.

1. Overview. As shown in FIG. 1, five prior art dice 20 are shown each having six faces and with each face having a number in dots placed thereon. The casino game 10 of the present invention is more general and can use X number of dice 20 with each die 20 having F number of faces 30. Under the teachings of the present invention, X can be any suitable number as well as the number of faces F. A player preferably initiates play of the casino game 10 by wagering a prescribed number of units. Thereafter, the casino game 10 begins with the player rolling the set of X dice. A total of Y "draws" (replacement rolls) are allowed after the original roll, and during each such draw, the player re-rolls any one or all dice and stands pat on the remaining dice. Once a total of Y+1 (Y replacement plus one original) rolls have occurred, or alternatively, the player "holds" all X dice, play of the casino game 10 ends, the hand is over, and the player's wager is settled according to a payoff table based upon the existence of any winning combinations in the held dice.

EXAMPLE I

In the following example X=6 dice, F=6 faces, Y=2 draws, and each face 30 of a die 20 has the following set of values {S}: {1, 2, 3, 4, 5, 6} as shown in the prior art and dice 20 of FIG. 1. One form of a payoff table under the teachings herein comprises payoffs for the following winning combinations:

TABLE I

| Winning Combination | Payoff |
|---|---|
| One Pair (e.g., 2 Sixes) | P1 for 1 |
| Two Pairs (e.g., 2 Sixes and 2 Ones) | P2 for 1 |
| Full House (e.g., 3 Fours and 2 Fives) | P3 for 1 |
| 6-of-a-Kind (e.g., 6 Fours) | P4 for 1 |
| 5-of-a-Kind (e.g., 5 Sixes) | P4 for 1 |
| 4-of-a-Kind (e.g., 4 Fours) | P4 for 1 |
| 3-of-a-Kind (e.g., 3 Fours) | P4 for 1 |
| 3-dice Straight (e.g., Four-Five-Six) | P5 for 1 |
| 4-dice Straight (e.g., Two-Three-Four-Five) | P6 for 1 |
| 5-dice Straight (e.g., Two-Three-Four-Five-Six) | P7 for 1 |
| 6-dice Straight (e.g., One-Two-Three-Four-Five-Six) | P8 for 1 |
| Nothing | P9 for 1 |

Note that some of the payoffs may return zero units (i.e., the loss of the wager for the player P). For example, a final hand consisting of "Nothing" may be a loser (i.e., P9=0). Note that some of the "payoffs" may "push" so that the player P simply keeps the wager 260 (i.e., P1=1). The payoffs P1 through P9 are designed to provide a broad range from minimal (or no) payoffs to large (or jackpot) payoffs. The selection of winning combinations and the number of payoffs can be any suitable amount to earn a desired casino house advantage as will be subsequently discussed.

It is to be expressly understood that the winning combinations in Table I are based upon faces 30 of each of the die 20 having a set of values {S}: {1, 2, 3, 4, 5, 6}, but that any suitable set of values {S} could be utilized such as card ranks such as: {S}={ace, king, queen, jack, ten, and nine}. In addition, the members of each {S} could be labeled with their faces as card ranks and suits. Any suitable symbol 40 such as a letter, number, graphic and/or color, individually or any combination thereof, could be utilized with any number, X, of dice having any number of faces, F.

Other hand values, both poker-like and non-poker-like, are also possible. For example, the value of a hand may be calculated as the sum of the individual dice (where the symbols 40 involve numbers). Alternatively, the value of a hand may be the sum of the three highest-ranked dice less the sum of the three lowest-ranked dice. In these cases, the payoff would be modified to reflect these possibilities. It can be appreciated that a wide variety of winning combinations can be selected and corresponding payoffs can be assigned under the teachings of the present invention by varying X, F, Y, and {S}. Under the teachings of the present invention, a novel method for playing a casino poker dice game having X dice, each of the X dice having F faces with a different symbol thereon so as to form a set {S} of symbols on each of the X dice. The method includes the steps of placing a wager 260, rolling the X dice, and then holding none, any, or all of the rolled dice in response to the step of rolling. The player re-rolls the non-held dice. The steps of holding and re-rolling occurs Y times after the initial roll. At any time after the first roll, the casino poker dice game of the present invention ends when the player holds all of the dice after any roll or when re-rolling occurs Y times. At the end of the game, the player is paid according to the payoff table 230 any payoffs for any existing winning combinations in the hand. As more fully explained below, this method can be adapted to a stand-alone casino game or into a bonusing casino game for an underlying gaming machine.

Figure 2:
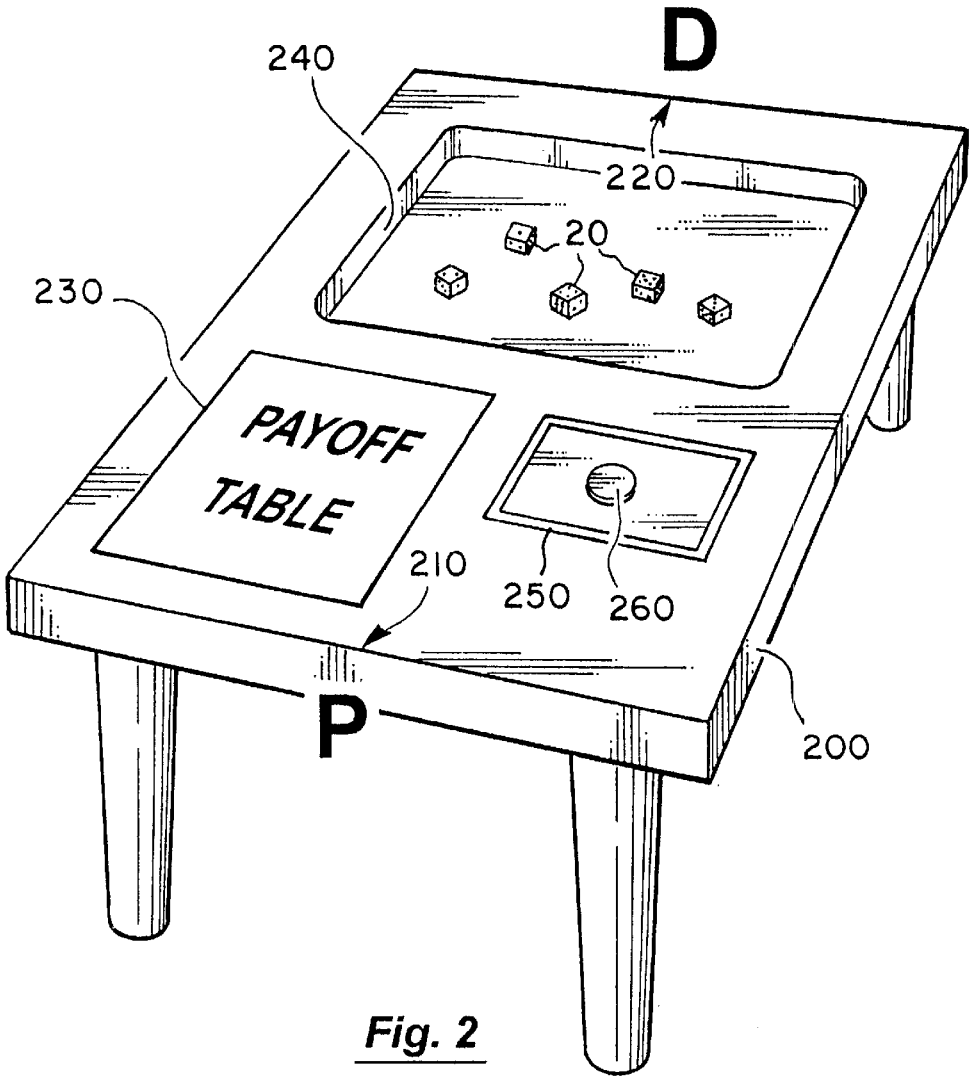
FIG. 2 illustrates the stand-alone poker dice casino game table of the present invention.

2. Stand-alone Casino Game. A first preferred embodiment, which is illustrated in FIGS. 1 and 2 and comprises a stand-alone casino game 10. In FIG. 2, the casino game 10 of the method of the present invention may be played on a table 200 having a player P position 210 and a dealer D position 220. On the casino game table 200 is a payoff table 230 and a recessed throw area 240. Also on table 200 is a wager area 250 upon which a wager 260 may be placed by the player P at position 210. The shape of the game table 200, where the payoff table 230 is located, the location of the wager area 250 and the design and location of the throw area 240 are matters of design choice and the present invention is not limited thereby.

Example II

In the following discussion, this embodiment of the casino game 10 employs conventional six-sided (F=6) dice 20 with X=5, Y=2 and {S}={1, 2, 3, 4, 5, 6}. The payoff table 230 in Table II is based upon a 10 unit (e.g., coin) wager 260. The player P places the wager 260 in area 250 to start play of the hand. The player P has an original or first roll of all five dice 20 in area 240 which results in the dice 20 showing values at the end of the roll. The player P may then hold none, any, or all of the five dice 20. If the player P decides to hold all five dice 20, the hand is over. Otherwise, the non-held dice are re-rolled by the player P in area 240. The player P may then again hold none, any, or all of the five dice 20 including the dice held in the prior re-roll. If the player P decides to hold all five dice 20, the game is over. Otherwise, the non-held dice are re-rolled by the player P. The final values of the five dice are compared to the following pay table, which assumes a ten-coin wager 260 in area 250 by the player P:

TABLE II

| Winning Combination | Payoff (coins) |
|---|---|
| 5-of-a-Kind 6s on 1st Roll | 400 |
| 5-of-a-Kind 5s on 1st Roll | 200 |
| 5-of-a-Kind 4s on 1st Roll | 175 |
| 5-of-a-Kind 3s on 1st Roll | 150 |
| 5-of-a-Kind 2s on 1st Roll | 125 |
| 5-of-a-Kind 1s on 1st Roll | 100 |
| 5-of-a-Kind on 2nd or Final Rolls | 50 |
| 5-dice Straight | 20 |
| 4-of-a-Kind | 14 |
| Full House | 10 |
| 3-of-a-Kind | 4 |
| 4-dice Straight | 4 |
| Sum of Dice >= 24 | 4 |
| Sum of Dice < 24 | 0 |

In Table II above, it is clear that the player P receives the highest payoff if a winning combination is obtained on the first roll. For example, if on the first roll, all sixes are rolled, the game is over and the player P receives four hundred coins from the dealer D based on the ten coins wagered. In Table II, the only practical winning combinations paying on the first roll are five of a kind. Clearly, a player would hold and not re-roll any dice and the hand after the first roll would be over. Furthermore, it is possible that the hand will also be over on the second roll since the player P could obtain five of a kind on the second roll and a five dice straight. At this point, there is no practical reason to re-roll and the player P would hold and receive the winning payoff from the dealer D. However, in the case where the player P wishes to improve his or her hand to achieve a winning combination, or a winning combination with a better payoff the player may selectively hold and re-roll the dice a third time under this example.

The following sets forth the player's strategy which recognizes that the player P has two separate decisions to make—one after the 1st roll and one after the 2nd roll. The decision after the 1st roll is the beginning position, the decision after the 2nd roll is the intermediate position, and the final roll is the final position.

Beginning with the intermediate position, each possible player strategy associated with each possible combination of five dice are: a) holding all 5 dice (1 possibility); b) re-rolling 1 die (5 possibilities); c) re-rolling 2 dice (10 possibilities); d) re-rolling 3 dice (10 possibilities); e) re-rolling 4 dice (5 possibilities); and f) re-rolling all 5 dice (1 possibility). For each of these possibilities, all possible subsequent rolls are considered, properly weighted according to their probability of occurrence, and compared to the pay table in Table II. This leads to an assessment of the theoretical expected value from each possible strategy at the intermediate position. The greatest such value, and its associated strategy, are chosen as optimal and saved. Thereafter, by working backward, the optimal strategy for the beginning position can be obtained. Toward this end, each possible combination of five dice is considered. The expected value of each possible strategy is calculated by comparison with the saved expected values for the intermediate position. As before, the greatest expected value and its associated strategy are chosen as optimal. The expected return is then calculated by weighting each possible beginning position by its probability of occurrence and its expected value, and summing over all such possible positions. It is found that a theoretical player's expected return, with optimal play and a 10-unit (i.e., coin) wager, is 9.72 units. Thus, the player's optimal expectation is −2.8% or a house advantage of 2.8%. This substantially equals the original wager 260 and it is desired that for optimum play that the player's expected return be within 10% of the wager. For non-optimal players, the house advantage will be even greater.

What has been shown above in Table II is an example of the casino game 10 of the present invention. It is to be appreciated that a wide variety of winning combinations, associated payoff values, amounts for wagers 230 placed, and the variation of X, F, and Y as well as the composition of {S} can be changed to create numerous and equivalent variations of the casino game 10 under the teachings of the present invention while preserving a house advantage and a player's expectation that is fair to the casino and to the player.

One variation to the method of the present invention is to permanently hold all dice throughout the game. Once dice are held they cannot be re-rolled. To implement this variation, the dealer D could place the permanently held dice to one part of area 240 or even on top of the table 200. The payoff table 230 would be changed to provide different payoffs for the winning combinations to accommodate this variation.

Another version would be to vary the value of Y (i.e., the value of the replacement rolls). For example, the payoff table 230 could have different payoffs for different values of Y (e.g., Y=0, Y=1, Y=2, and Y=3). The player P in such a variation would place a different valued wager 260 for each different value of Y. Or, a single payoff table 230 similar to that set forth in Table II above could be utilized and the value of Y could be randomly selected such as by rolling a separate die having different values of Y on each face of the die or by spinning a separate wheel having different values of Y on the wheel. The variation of Y adds additional excitement to the casino game 10 of the present invention. Or, the value of Y could be based upon the number of games 10 the player P successfully plays at the table 200. For example, after playing a given number of games, the value of Y could be increased thereby making it possible for the player P to obtain a winning combination or a winning combination with a higher payoff since additional re-rolls of the dice are possible.

In summary, the stand-alone casino game of the present invention in Example II is over in Y+1 or less rolls and provides a broad range of payoffs based upon the winning combinations. The payoffs in Example II are fixed according to the payoff table 230. In summary, the player P places a wager 260 to play the casino game 10. The player P then rolls the dice 20 and then, if necessary, re-rolls the dice Y number of times in order to receive an optimal winning combination resulting in the best payoff. The dealer D at the end of the hand pays the player P a payoff based upon any winning combination, if any is present.

Figure 3:
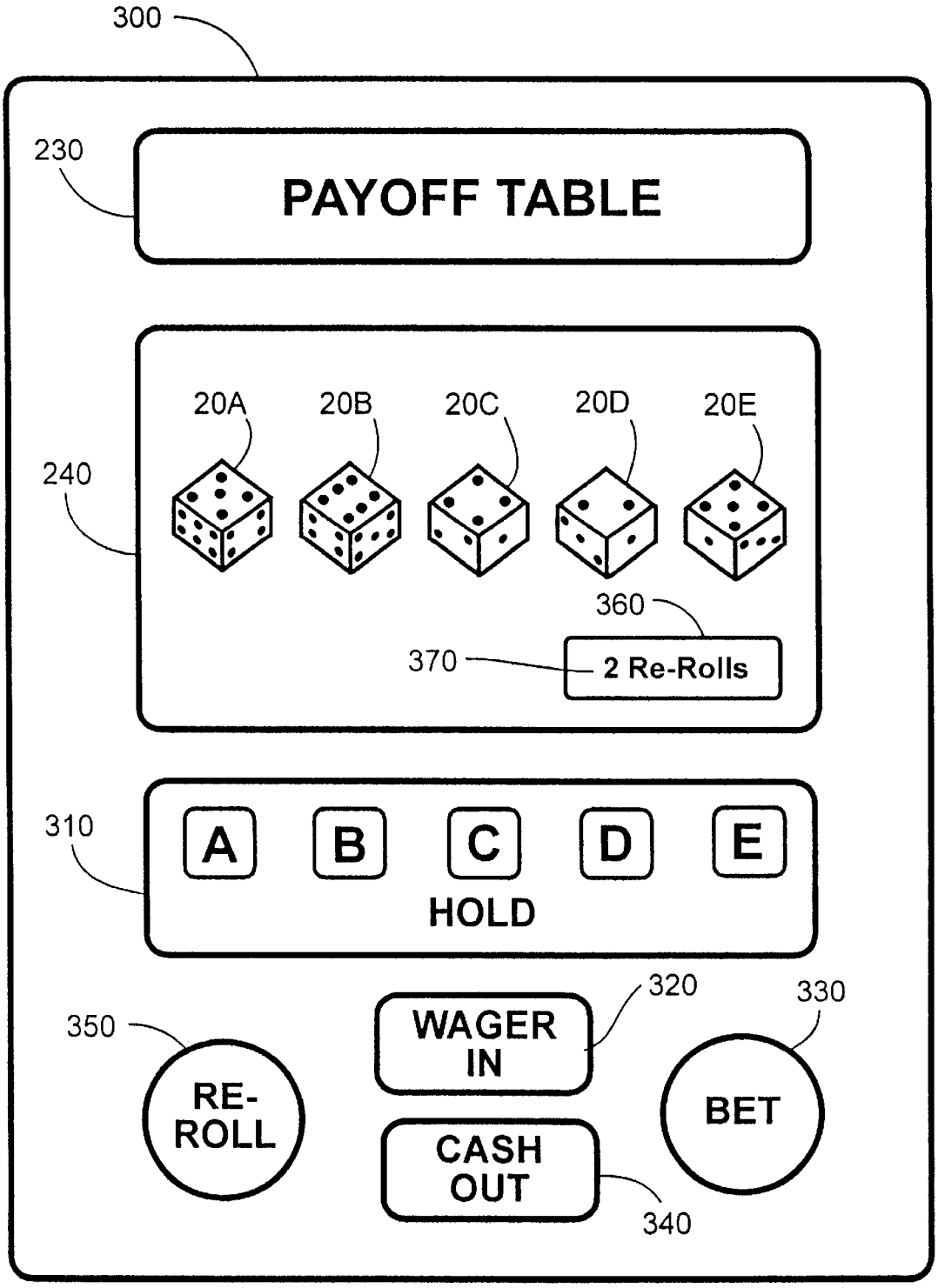
FIG. 3 illustrates a stand-alone poker dice gaming machine of the present invention.

It is to be understood that the stand-alone game shown in FIG. 2 which is a manually played game between a player P and a dealer D can also be incorporated into a stand-alone gaming machine such as shown in FIG. 3 so that a dealer D is not required. For convenience, as is true throughout the specification, like numerals refer to like functional attributes in the different figures and embodiments. Hence, in FIG. 3, a payoff table 230 is shown which functionally corresponds to the payoff table 230 in FIG. 2. The stand-alone gaming machine 300 further has a dice 20 play area 240 which, in this case, may be a video monitor such as conventionally used for video poker games, or which may comprise a plurality of mechanically driven dice which are conventionally available (e.g., each die 20 being operated by a stepper motor to assume a random position when rolled). Unlike the table game 200 shown in FIG. 2, provision must be made to hold dice after a roll and this occurs in area 310 by means of buttons A through E. Button A corresponding to die 20A, etc. This would correspond to similar buttons that are used in conventional video poker games which are selectively activated to hold a card during play of a hand of poker. Hence, when a player pushes, for example, button A, it becomes lit and the die 20A is not re-rolled. It can be appreciated that after a roll, all five of the dice shown in FIG. 3 can be held by pushing all five of the buttons A through E. In which case, the hand is over. Furthermore, it is well within the skill of the art to provide the function of the buttons A through E actually on area 240 when area 240 is a touch video screen so that a player may simply touch the dice or an area labeled "hold" near the dice to hold the dice before the next re-roll. How dice 20 are held before the next re-roll can be accomplished by many numerous and equivalent ways as this technology presently exists for hold cards in conventional video poker machines.

In FIG. 3, the player conventionally puts a wager 260 into the gaming machine 300 in area 320. How a wager 260 is inputted into a gaming machine is well known in the industry and comprises numerous approaches including, but not limited to: coin in, bill in, card in (credit, debit, or smart), establishing a credit on the machine which can be conventionally shown in a credit meter, the use of a ticket, etc. How a wager is inputted or credits established in the gaming machine 300 is not material to the teachings of the present invention. However, to commence play, a player must wager, or bet by pushing a button 330, to start the casino game 10 of the present invention. It is also conventionally known with respect to gaming machines that a player may bet one, two, three, etc. units and, therefore, the player typically has a choice as to how much to bet within a predetermined range of bets. In a conventional gaming machine based upon three separate bets, a player could bet one unit, two units, or three units (the latter commonly called a "max bet"). Hence, the bet function 330 could be a single button or three separate buttons corresponding to the amount bet.

To illustrate the teachings of the invention, a single bet button 330 is provided as shown in FIG. 3 and a payoff table 230 corresponding to the single bet. It is to be expressly understood, that three or five unit bets could be made by the player and that the corresponding pay table 230 would set forth the payoffs for each unit bet. This is well known in the gaming industry. Furthermore, the payoff table 230 could be printed or could be a dynamic pay table comprised of liquid crystal displays that specifically show only the payoffs for the precise amount bet. Also in FIG. 3 is shown the conventional cash out function 340, which enables the player to remove money from the machine 300 when the player is done playing at the machine 300. The cash out function 340 may be one or more structural devices such as a coin out mechanism, tickets dispensed, or the like. Function 340 could also be combined with function 320 in the case of a smart card so that the smart card, when inserted delivers credits to the machine, and when the cash out function 340 is activated, credits are delivered into the card. Again, how a player cashes out and the form of the "cash" is immaterial to the teachings of the present invention.

The first roll of the dice 20 occurs when the bet button 330 is pushed. After the first roll, the player makes a decision as to which dice 20 to hold based upon the winning combinations in the payoff table 230, and presses the respective hold buttons 310, and then presses the re-roll button 350. The held dice are not rolled but the remaining dice are re-rolled (i.e., Yi=1). Here, Yi refers to the instantaneous value of Y. Again, the player analyzes the symbol combinations on the re-rolled dice including the held dice and makes a decision. At this time, and based upon the procedure in Example II, the player has the ability to hold any of the dice. In other words, the previously rolled dice in buttons 310, A through E, are now unlit and all dice 20 may be re-rolled or selectively re-held if desired by the player. Again, the player selects which buttons 310, A through E, to activate to hold the respective dice. The pressed buttons, in a version of the method of the present invention, light up to indicate hold. The player presses the re-roll button 350 once again for the third and final roll (i.e., Yi=2). At this time, the machine 300 automatically determines the winning combination and, if a payoff is due based on the pay table 230, credits the player in a conventional fashion which is typically displayed on the machine 300, not shown. Whenever the player, after a roll, activates all five of the hold buttons A through E, the hand is over and the machine 300 determines the displayed combinations for the dice 20 and, if a winning combination exists, a payoff from the payoff table is paid. The hand is also over when Yi=Y=2 as this is the third and final roll. Again, the combinations displayed for the dice 20 are known to the machine 300 and, if a winning combination exists in the payoff table 230, a payoff is made to the player. It is well known in the gaming industry how to generate random combinations for the dice 20 based upon a random number program in the machine 300 and cause the rolled dice 20 to display the results from the random number generating program. These randomly generated rolled dice values are then used in a look up table, at the end of the hand, to determine whether a winning combination exists and, if so, the corresponding payoff is paid. All of this technology for accomplishing these individual functions is well known in the design and operation of gaming machines 300. The method of the present invention, as fully discussed and illustrated therein, however, is unique.

In the alternate embodiment, when the dice are once held they are permanently held during all subsequent re-rolls. Once the held buttons 310, A through E, are pressed after any roll of the dice they remain permanently lit until the end of the hand and the dice 20 they identify are never re-rolled.

In the alternate embodiment, the value of Y can be optionally displayed in display 360 such as a portion of the video screen 240. The value 370 of Y (shown to be 2 in FIG. 3) can be varied as previously discussed or the value of Y can be randomly varied, be based upon a function of the wager placed, vary as a function of the number of successive games played by a player, and vary in any other equivalent method. If Y is randomly varied according to a random number generator, then after placing the bet 330; the display 360 is activated to show the random selection of the value for Y. A dynamic payoff table 230 could then show the payoff associated with the selected value 370 of Y in one design choice. In this design choice, different values 370 of Y randomly selected would have a different payoff table which would be dynamically updated and displayed after the bet 330 is placed. Then the dice 20 would be rolled in the first roll. In another design choice, a static payoff table 230 would be provided and the random selection of Y would affect the ability of the player to achieve winning combinations and corresponding payoffs. In this design choice, when Y=1 it is more difficult for a player to have a winning combination and when Y=3, it is much easier for a player to achieve a winning combination. The variation of Y, as displayed in area 360, adds further excitement to the play of the game.

It is to be expressly understood, that the representation of the dice 20 in area 240 can be mechanical dice which are activated by a suitable device such as a stepper motor, could be graphical representations on a video screen of dice being rolled in free space, or any other rolling action. Indeed, in one type of graphical presentation, the held dice could be physically shown to be removed to another area of the video screen leaving only the remaining dice to be re-rolled showing being rolled, shown as if they are thrown from a cup or the like.

Figure 4:
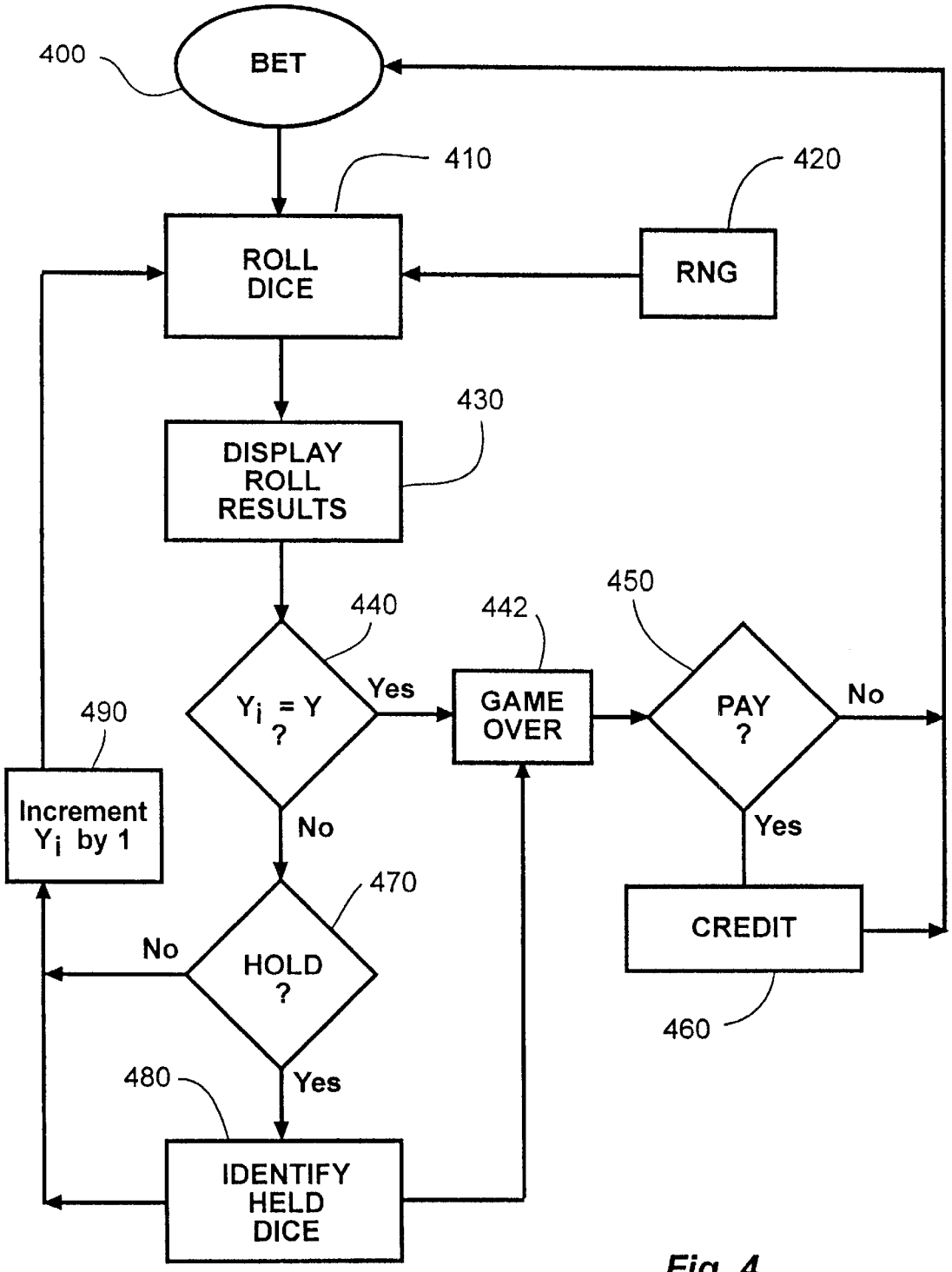
FIG. 4 illustrates a functional flow chart for the stand-alone poker dice gaming machine of the present invention.

In FIG. 4, a functional method for implementation with a gaming machine 300 (e.g., microprocessor controlled or any suitable processor, controller, or computer) operates as follows. The player in stage 400 places a bet (corresponding to units of a wager 260) such as by activating bet button 330 in FIG. 3. Stage 410 is entered wherein the gaming machine 300 causes the dice 20 to be rolled based upon results from a random number generator (RNG) 420, which can be resident hardware or software in the gaming machine 300. It is well known in the gaming industry how to design and implement random number generators 420 to provide a random roll of the dice 20 that is fair to the player, fair to the casino operator, and approved by a local gaming authority. The gaming machine 300 causes the mechanical dice 20 to assume a rolled position, or in the case of a video display, causes the video display dice to assume the rolled positions showing resultant values. The gaming machine 300 displays the roll results in stage 430. Stage 440 is now entered to determine whether the instantaneous value of Y (shown as $Y_i$) equals Y. If so, the game over stage 442 is entered. The game is over if the desired value of re-rolls (i.e., the value of Y) has occurred. If the value of Y has been reached, the game is over and stage 450 is entered to determine any payoffs. If Y hasn't been reached, then stage 470 is entered. The gaming machine 300 responds to any one of the buttons 310 that are activated to a hold status to a hold status by the player in stage 480. These buttons are read in stage 490. If the hand is in stage 480 and all buttons 310 are activated, the game also ends and stage 450 is entered. It is the obligation of a player to press all of the hold buttons when a winning combination occurs before the next re-roll. If the player fails to do so, then the player misses the opportunity for a winning payoff. For example, if after the first roll, the player has "5 of a Kind" shown in stage 430, the player is required to activate all of the hold buttons A through E in area 310. If not all the dice are held in stage 480, stage 490 causes the instantaneous value of $Y_i$ to increase by 1 and $Y_i$=1. In stage 410, only the non-held dice are re-rolled based upon results from the random number generator 420 and displayed in stage 430. Again, the game is over in stage 440 if $Y_i$=Y. Otherwise, stage 470 is entered and the player selects any of the dice 20 to be held by pushing buttons, A through E, in area 310 which are identified in stage 480 and the game continues as described above until stage 490 increments $Y_i$ by 1 and $Y_i$=1. The non-held dice are then re-rolled in stage 410. The results are displayed in stage 430 and the game is over in stage 440 since $Y_i$=Y=2 in this example. At this point, only stage 442 is entered and the final determination is made as to whether or not the resulting combinations earn a payout according to the payoff table 230 is made in stage 450. Any payoff is a credit (or actual coins) occurs in stage 460. It is to be understood, that while actual values (e.g., 100 coins) are used in the examples herein that the payoff can be any suitable award such as, but not limited to: coins, dollars, credits, objects (i.e., car), comps (i.e., free dinner), free plays (e.g., 5 free plays of the underlying game), multiplies (e.g., 15× the wager made to the underlying game), etc.

Figure 5:
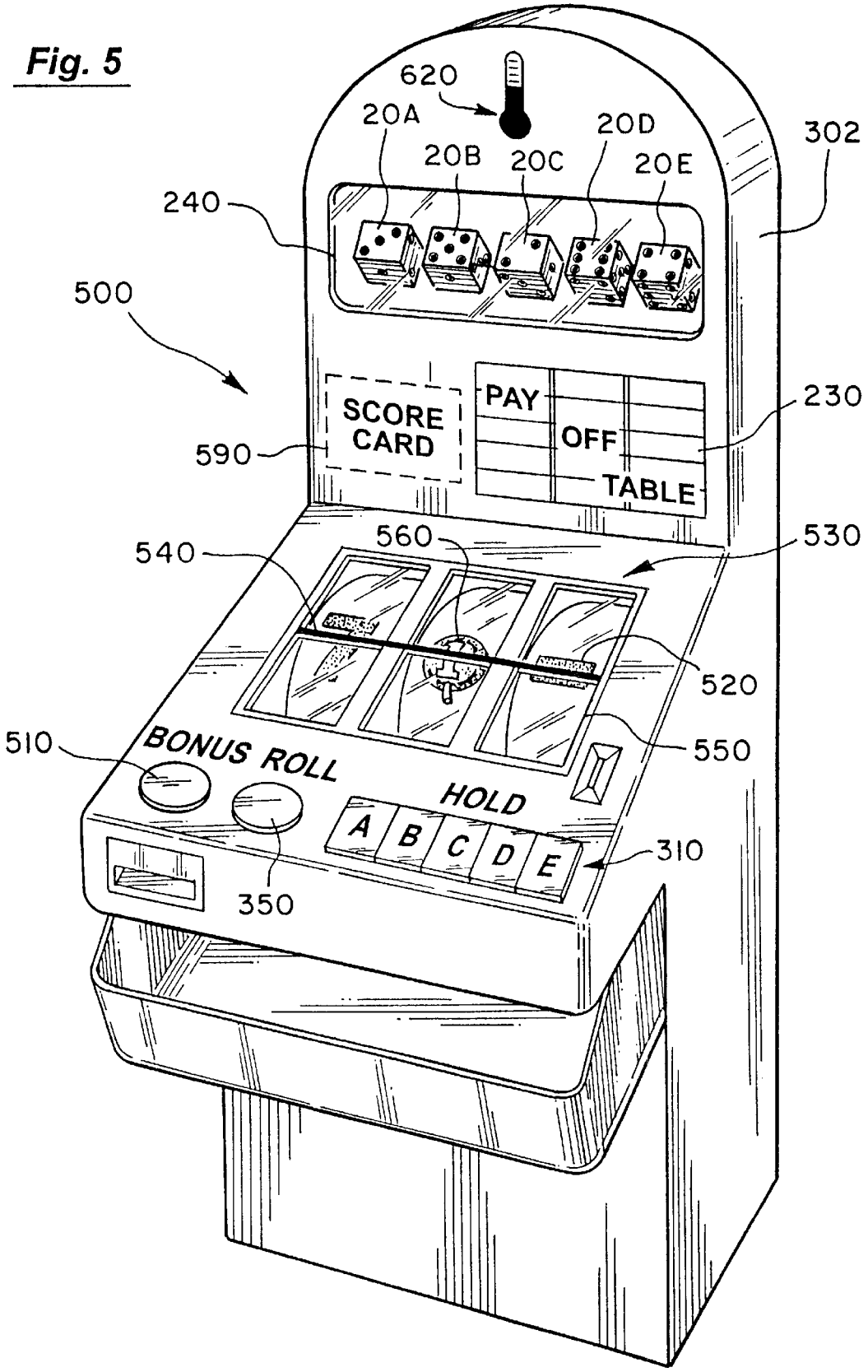
FIG. 5 illustrates the bonus poker dice casino game of the present invention.

3. Bonus Game. In a second preferred embodiment, the invention is utilized as a bonusing feature for a primary or underlying gaming machine. The primary gaming machine could be a traditional reel slot, video reel slot, video poker, keno or other variety of casino game. The nature and type of the underlying gaming machine does not limit the teachings contained herein. FIG. 5 shows a conventional reel slot game 500 having bonus game 10 according to the method of the present invention built into an upright rear portion 302 of the slot game 500. The bonus game 10 can be on top of, on the side of, near, or adjacent the underlying gaming machine 500. The underlying reel game 500 has conventional devices for accepting wagers, displaying wagers, displaying credits, playing the game, betting, displaying payoffs for winning combinations, cashing out, etc. all of which are not shown, but well known in the gaming industry. The bonus game 10 can be comprised of dice 20 that are conventionally available mechanical dice or dice graphically represented in a video display as shown in FIG. 3. The bonus payoff table 230 can be printed, displayed in a digital display or incorporated and displayed in the same area 240 that displays the bonus game. For example, area 240 could be a video screen. Hence, FIG. 5 is but one representation of many equivalent designs under the teachings of the present invention. In addition, a bonus button 510, a re-roll button 350, and hold buttons 310 are provided separately on the underlying game 500 or can be incorporated as touch areas when area 240 is a video display.

EXAMPLE III

Consider a conventional slot machine 500 in which a particular winning combination of symbols is due a game payoff, GP, of 60 coins. In this example, the player can optionally take the 60 coin payoff from play of the underlying slot machine 500 or can play the bonus game 10 (X=5, Y=1, F=6, {S}: {1, 2, 3, 4, 5, 6}) by pressing button 510 to initially roll the dice 20. The payoff of 60 coins now becomes the wager 260 for the bonus poker dice game 10 of the present invention. Rather than simply pay the player a game payoff, GP, of 60 coins, the player in this example can use the game payoff GP to play the bonus game 10. Consider the following bonus payoffs BP for winning combinations using the 60 coins won in the underlying slot game 500 as the wager 260 for the bonus game 10:

TABLE III

| Winning Combination | Payoff (coins) |
|---|---|
| 5-of-a-Kind 6s | 1000 |
| 5-of-a-Kind 5s | 500 |
| 5-of-a-Kind 4s | 400 |
| 5-of-a-Kind 3s | 300 |
| 5-of-a-Kind 2s | 200 |
| 5-of-a-Kind 1s | 100 |
| 4-of-a-Kind | 90 |
| 5-dice Straight | 80 |
| Full House | 70 |
| 3-of-a-Kind | 60 |
| 4-dice Straight | 50 |
| Nothing | 35 |

As an example, the player pushes bonus button 510 to wager the 60 coins won in the underlying game. The dice 20 are initially rolled and result in a combination of: 3, 3, 5, 5, and 6. The player presses the hold buttons A, B, C, and D corresponding to dice 20A, 20B, 20C, and 20D which holds the dice as 3, 3, 5, 5. Dice 20E having the "6" value is not held and the player hits the re-roll button 350 in an attempt to obtain either a 3 or a 5. The results of the re-roll of dice 20E results in a 5 so that the player obtains a full house: 3, 3, 5, 5, and 5. Since Y=1 in this example, the game is over and the player receives 70 coins.

An analysis algorithm identical to that described above for Example II yields an optimal solution with player expected outcome for the bonus game 10 (or, bonus payoff BP) of 60.55, 81.38, and 111.73 coins, for Y=1, 2, and 3, respectively. Thus, the present invention could be used as a method to enhance game play while retaining, essentially, the previous player's expectation PE for the underlying slot machine (provided Y=1). It can be appreciated that the present invention may be used, with proper selection of X, Y, F, and {S} together with the winning combinations and the payoffs in the payoff table 230, to create a bonus payoff BP of arbitrary expected outcome. In this fashion, the invention can be used either as a bonus game or as a payoff mechanism with known, maximum, average payoff.

In the above example, the player's expectation, PE, is roughly equal to the bonus payoff, BP, of the underlying game and, therefore, the player is not penalized, over time, for playing the bonus game 10. However, the player upon winning the underlying game can risk or gamble the game payoff, GP, on the possibility of a much higher payoff which adds considerable excitement to the playing of both the underlying game 500 and the bonus game 10.

The game payoff GP in the underlying game 500 varies, of course, based upon the winning combinations earned in the underlying game. The bonus game 10 can receive some or all of the different valued game payoffs GP to play the bonus game 10 of the present invention. In this event, payoff table 230 can be dynamic having a set of bonus payoffs for each of the game payoffs in the underlying game 500. Hence, when the player receives an underlying game payoff GP of 10 coins, and pushes the bonus button 510, the payoff table 230 dynamically changes to provide the bonus payoff values BP corresponding to a ten-coin (or unit 10) wager 260 (which, of course, is the game payoff GP). The payoff table 230 can be a matrix of liquid crystal displays. When the player receives a twenty-coin game payoff GP a different bonus payoff table is displayed. It may be that in some designs only a single game payoff GP such as in the example above of sixty coins is permitted to play the bonus game 10 of the present invention in which case the payoff table 230 can be static such as a printed payoff table.

In Example III, Y=1 so that the re-roll button 350 and the hold buttons 310 are required. If Y=0, then the input 350 and the hold buttons are not required.

In an alternate version, once a hold button 310 is pushed, it is permanently held throughout all subsequent re-rolls, the bonus game 10 of the present invention functions as previously discussed. Likewise, in the alternative where values of Y vary, such a "variation" can easily be accomplished by having the random appearance of a symbol on the reels 530 appear either on the payline 340 or anywhere within the area 550. For example, a graphic symbol 560 with numerical symbols such as 1, 2, or 3 could randomly appear. This symbol could then be displayed such as shown by the dotted line area 590 in FIG. 5. Hence, when a winning combination appears in the play of the slot game 300(or any other suitable bonus condition), the player is then entitled to the Y value obtained earlier in the play of the game 500 from the appearance of symbol 560. It may be that several values of Y may appear in the play of the game before a winning combination is obtained. In which case, the last value of Y would be the value controlling play of the bonus game. Hence, several Y values may be displayed in display 560 before a winning combination is obtained, but it is the last value that controls. It is also to be expressly understood that such a symbol 560 could also be the bonus condition that causes play of the bonus game to initiate as will be discussed subsequently.

In yet another version of the method of the present invention, the graphic symbol 560 is always the value "one" and whenever it randomly appears on the pay line 540 (or elsewhere) then the value of Y in display 590 is incremented by "one." The initial value of Y can be set to "zero" or to "one" (at the start of play of the underlying game and/or after the end of a bonus game) and as the play of the underlying game 500 continues, the value of Y is incremented with every appearance of the symbol 560.

a. Initiation of Bonus Game

Many conditions can be used to initiate the bonus poker dice game 10 and, in fact, such conditions can also be used to initiate other types of bonus games. The conventional slot machine 500 of FIG. 5 functions to operate in conjunction with the present invention as a bonusing game. The underlying slot gaming machine 500 employs either video representations of reels or physical reels 530. The bonus game 10 initiates via a special bonus symbol or a combination of symbols 520 appearing on the slot gaming machine, for example on the payline 540 or anywhere in display window 550. In the preferred embodiment, one, some, or all of the winning combinations in the play of the underlying game are conditions that initiate the bonus game. Each of these winning combinations have a game payoff value, GP, which is used as the wager in the bonus game under the teachings of the present invention. Each different game payoff, GP, value in the preferred embodiment would have its own set of bonus payoffs set forth in table 230. Hence, a player would be able to make a decision whether to wager the game payoff GP of the bonus game or to simply take the game payoff value GP and continue play of the underlying game. The bonus payoffs, BP, for each winning combination in the underlying game 300, over time substantially equals the game payoff value, GP, for the winning combination in the underlying game. In an alternate version, a special bonus symbol either appearing on the payline 340 or in the area 550 could initiate the bonus game. In this alternate version, a winning combination of symbols need not occur in the play of the underlying game. Rather, the bonus symbol appears which does not necessarily have associated with it a game payoff value, GP. It simply is a symbol that allows the player to play the bonus game of the present invention. Hence, the player does not have to make a choice on wagering the game payoff value GP to play the bonus game. Rather, the player randomly receives the bonus symbol in the play of the underlying game, and qualifies to play the bonus game. In these designs, under the teachings of the present invention, the funding for the bonus game can be worked into the payouts in the underlying game.

In this alternate version, the player commences play of the bonus game. Furthermore, the special symbol, as previously discussed, could also bear a numerical value 4Y so as the player plays the underlying game 500, the appearance of the special symbol with a Y value causes further excitement since the value of Y varies randomly. Of course, when the value of Y is greater, the player has more re-roll opportunity to improve his final hand and thereby increase his bonus payoff.

Alternatively, the initiating condition for the bonus game 10 is randomly assigned and unrelated to symbols appearing in the underlying game machine 500. This can occur with a timer being randomly set with values based upon a random number generator. After being set, the timer times out and initiates the bonus game 10. Many well known designs are available for providing a step of randomly initiating a bonus condition such as a timer timing out, etc. In this case, the wager 260 for the bonus game 10 is zero and the bonus game 10 is "free" (i.e. a wager of zero). However, the wager 260 could also be nonzero such as simply the wager for the underlying game.

As another example, the present invention is utilized as a bonus game 10 for an underlying game of video poker. For example, instead of paying a Full House (obtained in the conventional underlying game for video poker) a prescribed number of coins GP, the bonus game 10 is played with a pay table 230 such that the player's expected PE return is similar to the aforementioned game payoff GP with little, if any, change in player's expectation for the underlying game. Hence, the bonus game 10 initiates when a payoff condition occurs in the underlying table game. The initiation could occur with only one, some, or all of the payoffs for winning combinations in the underlying table game.

The initiation condition can also be a function of an accumulated value won or lost in the underlying game. For example, the player at underlying game 300 accumulates winnings of a predetermined value such as 100 coins over many games. This accumulation can be displayed in a graphics display 620 such as a temperature gauge or a fuel gauge. Obtaining the value of 100 coins triggers the bonus game 10 and 100 coins becomes the wager 260 to play the bonus game. Alternatively, the 100 coins is awarded to the player in addition to playing the bonus game. Or, the 100 coins are not awarded to the player, but instead the bonus game is played, etc. Likewise, the graphic display 620 can show a player accumulating losses over many games such as showing a display where an object sinks deeper and deeper into a well, or the like. When a predetermined accumulated loss value has been obtained, such as losing 100 coins, this can be the bonus condition that triggers the play of the bonus game. While the above discussion is based upon values of winning or losses over many games, other suitable triggers could be used as the condition signal to play the bonus game of the present invention. For example, the bonus trigger condition can be counting player wins or player losses over many games. That is, whether the game is won or lost. For example, twenty wins could qualify for the bonus game, or twenty accumulated losses would qualify. Likewise, the condition for the bonus game can initiate based upon an accumulated number of games being played which can either be a predetermined number or can be a random number. For example, every twenty games qualifies the player to play the bonus game or a random number selected in a range that, over many games, averages to be once every twenty games. While these are all variations of approaches to provide conditions for initiating the bonus game of the present invention, it is to be expressly understood that many other equivalent conditions could initiate a bonus game and that the present invention is not limited to how the bonus game condition originates.

Figure 6:
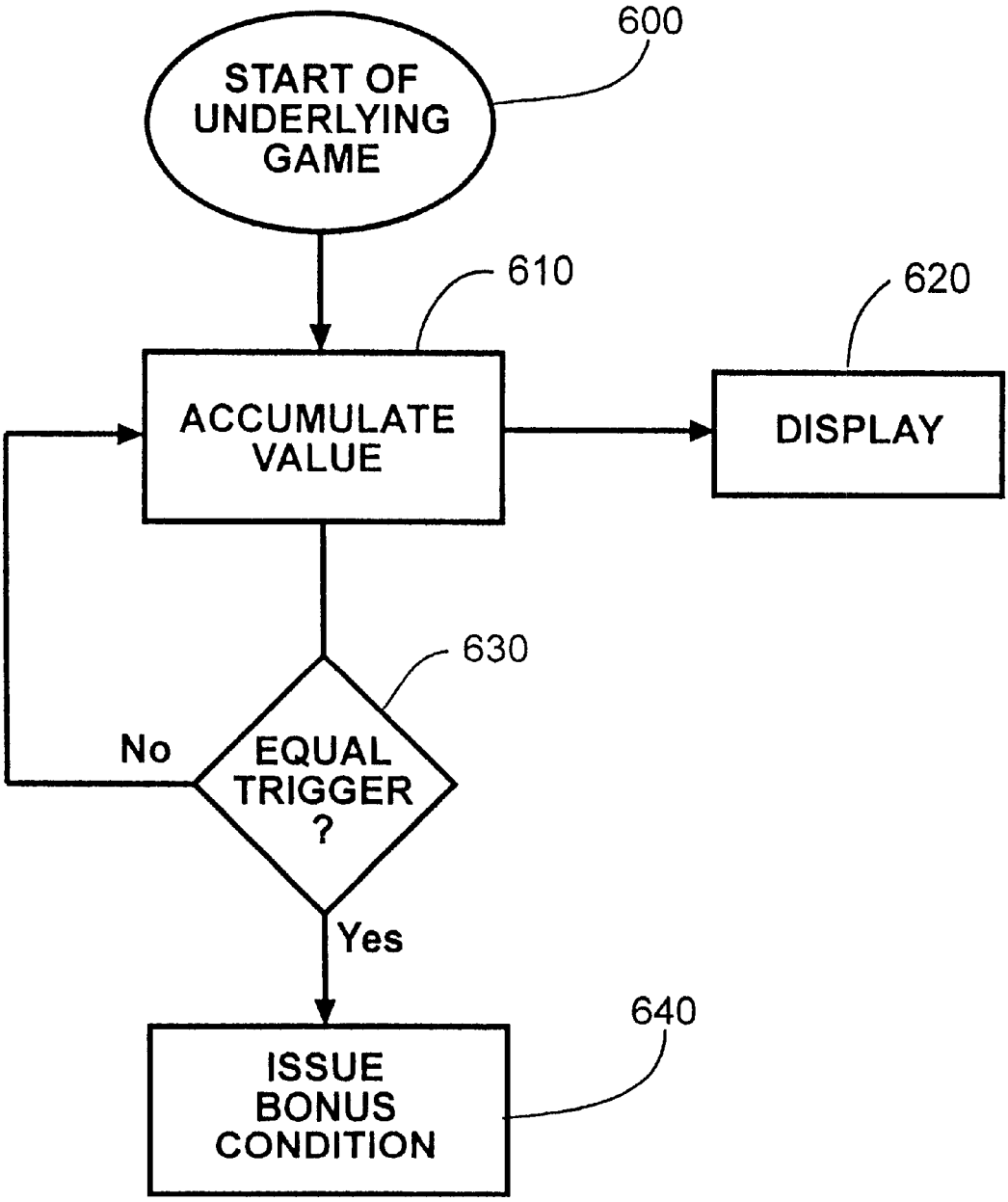
FIG. 6 is a functional flow chart for issuing a bonus condition under one method of the present invention.

FIG. 6 sets forth a functional flow chart that can be incorporated into the underlying game 500. When the start of the underlying game 500 occurs in stage 600 such as is conventionally done by a player sitting down and placing a bet, stage 610 is entered and the underlying game 500 accumulates value. As discussed in the preceding paragraph, the accumulated values could be units won over many games, units lost over many games, counting player wins or players losses over many games, or simply counting games played, etc. As the values are accumulated in stage 610, a suitable graphics display 620 could appear such as shown in FIG. 5 with the temperature gauge graphic 620. Any suitable graphic display could be used. In stage 630, the underlying game determines whether the instantaneous accumulated value determined in stage 610 equals a trigger value in stage 630. As discussed, the trigger value can be set or can be randomly varied within, for example, a range of values. The random selection in the range of values being under control of a random number generator. If the trigger has not been reached, the process re-enters stage 610 to accumulate the next value, etc. Hence, as values are accumulated in 610 and tested in stage 630, the display 620 is updated to provide feedback to the player. When the instantaneous value equals the trigger value in stage 630, the underlying game issues a bonus condition in stage 640 causing the bonus game to be played.

As another example, the methods of the present invention may be utilized in a bonus game 10 for an underlying table game. The present invention may be utilized as a part of the main wager, or as part of a side wager in the table game. For example, in a live table game of Blackjack, a separate wager may be made to participate in the bonus game 10, based on the outcome of the main wager. For example, a wager 260 of $1 is made upon the player receiving a suited natural. Should the player receive such a hand (i.e., suited natural in single deck=4/52×4/51×2=0.012—roughly a 1 in 84 chance), the bonus game 10 may be implemented with an average return of $72.50, leading to an overall expectation, for the side wager with optimal play, of roughly −12%. Here, the invention may be utilized with conventional dice as shown in FIG. 2. The present invention may also be utilized alone with or without an associated wager 260. It may also be utilized as a dispensing means with an expected value and distribution about said value.

The bonus game 10 of the method of the present invention may be included within other table games, machines, or systems. For example, the bonus game 10 could be used to reward coins to players in a linked progressive application. In a linked progressive bonusing system, several machines are linked together. Generally, a pool of money grows until reaching some prescribed level. At this time, the system goes into "bonus mode." At this time, the present invention may be utilized by randomly awarding eligible players a free bonus game, together with the associated win which is taken from the pool of money. This process can continue until the pool of money is exhausted, or until some other means is utilized to end the bonus mode. Hence, the bonus game shown in FIG. 5 could be located at each machine in the progressive system or could be a large bonus game located above, but visible to all progressive machines. In the latter version, each progressive machine would still have the inputs 510, 350 and 310.

The foregoing is not meant to be limiting but is intended instead to provide examples of multiple uses for the present invention, as a bonusing feature to an underlying game 500 and/or as a means of dispensing a known average number of coins, albeit with some fluctuation about the average, from game to game.

A number of different embodiments have been discussed for initiation in the method for the bonus game 10 of the present invention. It is to be expressly understood that "how" the bonus game is initiated can comprise a number of equivalent approaches and the method of the present invention is not to be limited by those specific approaches discussed above.

4. Alternate Bonus Game Embodiments. The bonus game 10 is robust in that it can accommodate varying methods of play.

a. Playing Z Hands

In an alternate embodiment, the methods of the present invention are utilized as a bonus game 10 to an underlying game whereby a total of Z hands are played to finish the bonus game 10. A method for initiating a condition to play a hand of the bonus game 10, has been previously discussed. After each hand, however, a dynamic score card 590 (shown in dotted lines in FIG. 3) is updated and points are assigned based on the value of the hand. The score card 590 can be a bank of liquid crystal displays, a touch video screen, or part of the video screen of the dice. Once Z bonus hands are played, the player's total points are compared to a payoff table 230 and a bonus paid.

Consider the following three score card examples:

TABLE IV

| | Payoffs (units) | | |
|---|---|---|---|
| Entry | Schedule A | Schedule B | Schedule C |
| 3 of a Kind | Sum of dice | 20 | Sum of dice |
| Full House | 25 | 25 | Sum of dice |
| 4 of a Kind | Sum of dice | 30 | Sum of dice |
| 4-dice Straight | 30 | 35 | Sum of dice |
| 5-dice Straight | 40 | 40 | Sum of dice |
| 5 of a Kind | 50 | 50 | Sum of dice |
| Chance | Sum of dice | 10 | Sum of dice |
| TOTAL | Sum of Entries | Sum of Entries | Sum of Entries |

Three separate pay schedule examples, A through C, are shown. Schedule A represents a hybrid schedule representative of the conventional YAHTZEE home game (some payoffs are fixed, some payoffs are variable and based on the dice values). Schedule B represents a fixed schedule of payoffs, and Schedule C represents a variable schedule of payoffs.

For each schedule assume the following rules are in effect for filling out the score card 590. At any point in the game, each of the seven entries is either filled (with a zero or nonzero value) or empty. After each hand, the result must be input by the player into one and only one of the empty score card entries. If the hand does not qualify for that entry, it will be scored as zero (e.g., with only the "4 of a Kind" and "5 of a Kind" entries open, if the final hand value is 3-3-5-5-4, then a score of zero must be entered into one of the two remaining open entries). A "5 of a Kind" hand, if the "5 of a Kind" entry is filled (either with zero or a non-zero value), can substitute for any other open entry. A "5 of a Kind" hand, if subsequent to a previous "5 of a Kind" entry used as such could also earn an additional 100 point bonus.

EXAMPLE IV

The preceding rules and score card are illustrative and are not meant to limit the teachings of this invention.

Assuming X=5, Y=2, F=6, {S}: {1, 2, 3, 4, 5, 6}, and Z=7 hands, then the following values (in units) exist for these score card games of Table IV assuming optimal play: Schedule A=141.7 units, Schedule B=143.5 units, Schedule C=109.3 units. Hence, an underlying gaming machine initiates the bonus condition as discussed above. In this example, assume Schedule A and assume the player is paid an immediate bonus of 5 units for each visit to the score card, then the cumulative score card worth is 141.7+7×5=176.7 units. The score card bonus (average value 141.7 units) may be dispensed only upon completing the entire score card. If it is desired to have the score card completed, on average, every 175 spins, then this can be accomplished in several ways. For example, the underlying game 500 can initiate one hand of the bonus game, on average, every 25 spins. In this fashion, the player requires 7 visits to the score card 590 to complete it. The bonus game is played "in parallel," with play of the underlying game 500 and the player is thus encouraged to continue playing the underlying machine 500 in order to finish the parallel bonus game 10. Alternatively, the underlying game can initiate seven hands of the bonus game 10 (thus allowing the player to fill the score card 590 completely) every 175 spins. Other means, including randomly selecting Z or how many hands to play on each visit to the score card, are variations.

Figure 7:
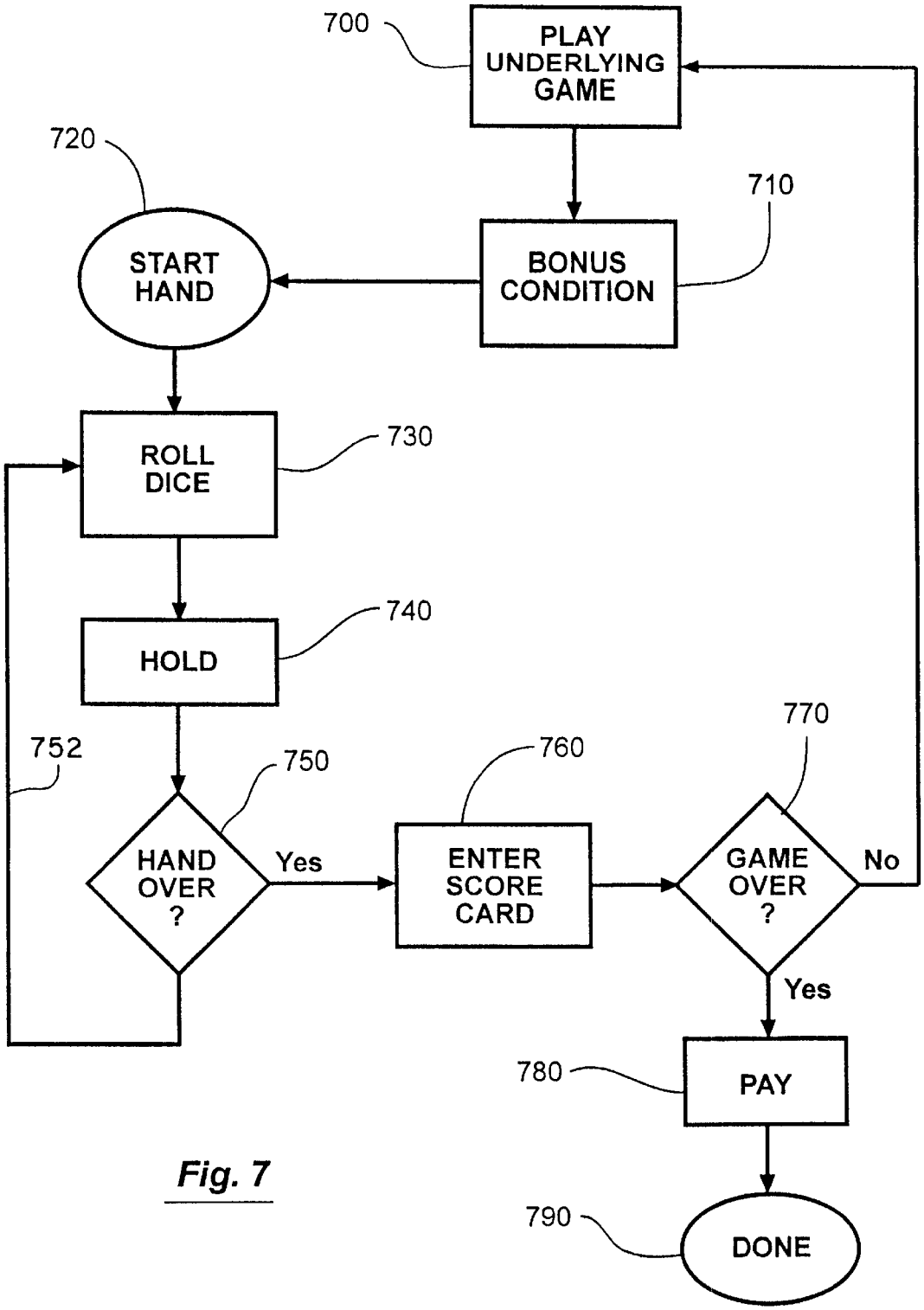
FIG. 7 is a functional flow chart for one of the bonus dice games of the present invention playing Z hands.
Figure 8:
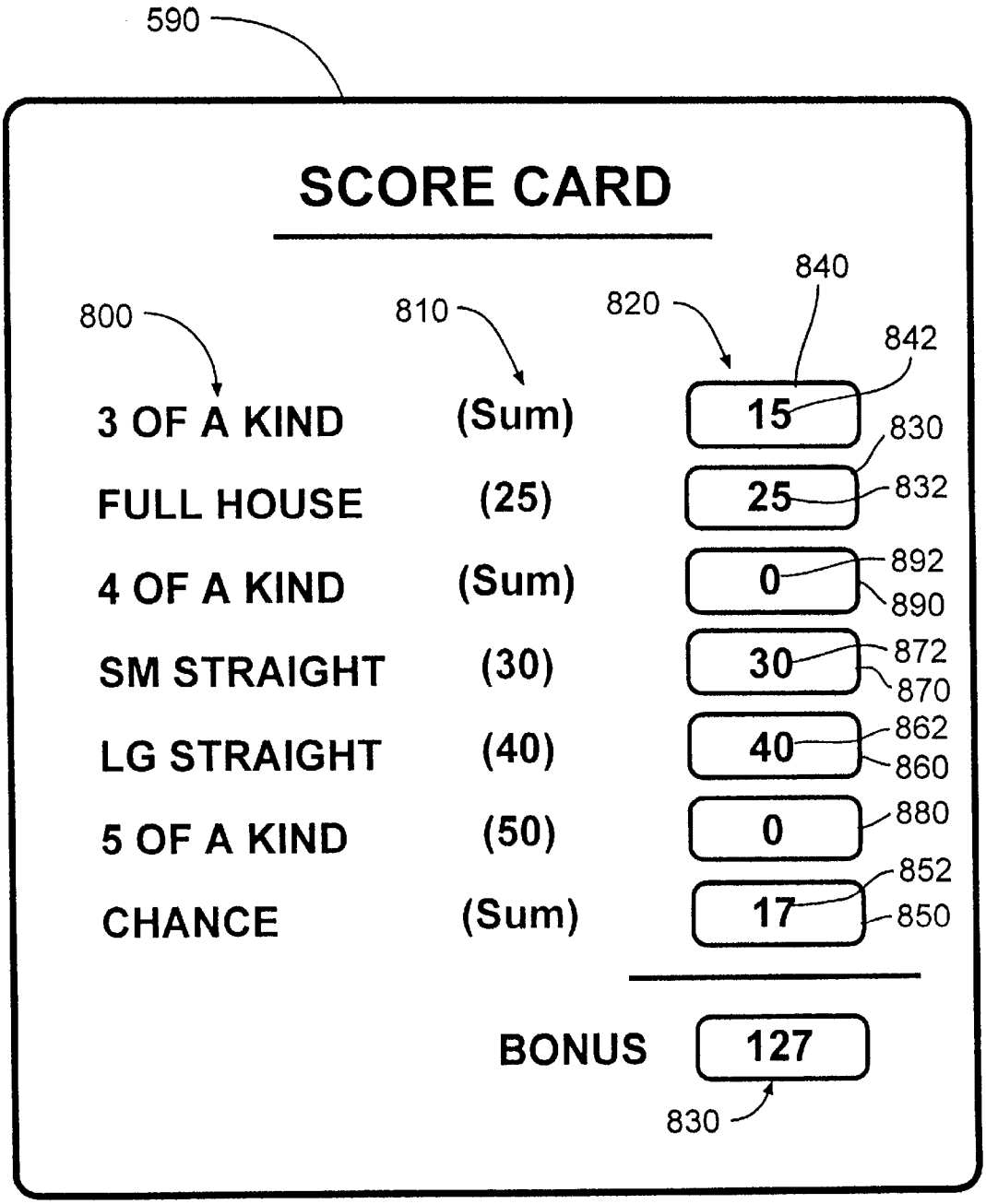
FIG. 8 is an illustration showing a displayed score card of the present invention.

In FIG. 7 the functional flow chart for playing Z hands of the bonus game 10 of the present invention is set forth. It is to be understood that with the computer-based design of the underlying game 500, that this functional set of steps can be programmed to interface with the switches 510, 350 and 310, the dice 20, the score card display 590, the display for the payoff table 230 (if any), etc. In FIG. 7, in typical fashion, a player initiates the play in stage 700 of the underlying game 500. The player plays the underlying game 500 and a bonus condition 710 initiates as discussed above. This causes stage 720 to be entered which starts the first hand and, as before, with reference to FIGS. 4 and 5, play of a hand of a bonus game 10 occurs. Hence, in stage 730, the dice 20 are rolled, in stage 740, the player makes a hold decision by selectively activating switches 310. In stage 750, a decision as to whether or not the hand is over which involves the steps previously discussed of stages 440, 470, 480, and 490 occurs. Hence, re-rolling occurs through loop 752. Eventually, and as taught above, the hand is over and stage 760 is entered. In FIG. 8, the details of one possible variation for the score card 590 is shown. It is to be understood that in FIG. 5, a separate payoff table 230 is not needed in the play of this version of the method of the present invention. The score card 590 shows the winning combinations 800, the payoff values 810 for each hand and provides a touch and display area 820. Also the score card 590 provides a display 830 for displaying the total bonus payout award after the end of, in this example, seven hands.

In stage 760, the player has just obtained the results of a hand, in a manner as discussed with respect to FIGS. 1 through 5. Assume the results are: 3, 3, 3, 4, 4 (corresponding to dice 20A, 20B, 20C, 20D, and 20E, respectively) which corresponds to a winning combination 800 of a FULL HOUSE which results in a payout 810 of 25 units. In stage 760, the system waits for the player to select the proper entry in the score card which would be entry 830 in this example and the player touches the area and the payoff 832 of 25 is displayed. Stage 770 is entered to determine whether or not the game is over. This stage 770 simply counts the number of hands and if, in this example, Z=7, the game is over. However, if the hands are not yet completed, then stage 700 is re-entered and the process repeats. Assume, in the next hand, stage 760 is entered with the results of a hand being: 6, 3, 3, 1, and 4. This roll of the dice for the hand only matches the chance entry and the player has the option of pressing area 850 to enter the sum of this roll which is seventeen and is shown by 852. Assume in the next hand, the results of the final roll are 5, 4, 3, 2, and 1. This is a large straight and the player would touch area 860 and the bonus award of 40 (as shown by 862) would appear. Assume the next hand the player receives in stage 760 is 6, 5, 4, 3, 2, which is another large straight. The player, at this point in time, has the option of entering this as a small straight by touching area 870 and the bonus payment of 30 (as shown by 872 would be shown. The next hand, however, when entering stage 760 is 1, 3, 5, 6, 1, and there is no opportunity to match an entry 800. However, the player must make an entry so the player selects "5 of a Kind" and touches area 880 causing a zero to be entered. In the next hand, the player receives 2, 2, 1, 1, 3, and the player selects area 890 again causing a "zero" 892 to be entered. In the final roll of the Z hand bonus game, in stage 760, the player in this illustration receives 4, 4, 4, 1, 2, and touches area 840 causing the sum of fifteen 842 to be entered. Seven hands have now been played and in stage 770 this is detected, causing the system to enter stage 780 and all of the bonus awards are added together and displayed in area 830 as, in this illustration, 127 units which is then paid to the player. The Z hand bonus game is now over in stage 790. It can be observed, that this bonus game according to the method of the present invention is played in parallel with a number of games in the underlying gaming machine.

In an alternate version, the player may be given the option to "reset" the game, for example if unhappy with its progress.

In an alternate version, the player initiates a stand-alone casino game 10 by wagering 260 a prescribed number of units. Each of the above poker hands are assigned a value. Thereafter, a total of Z hands are played. After each hand, a score card is updated and points are assigned based on the value of said hand. Once Z hands are played, the player's total points are compared to a payoff table 230and the wager resolved.

In an alternate version, suitable for both stand-alone and bonusing designs, Z hands are played and after each hand, the value of the player's hand is compared to a payoff table and the player is immediately rewarded, as applicable, based on the value of the hand.

In an alternate version, Z hands are played and the player, to continue to the next hand, must make an additional wager.

Clearly, the number of entries 840–860 in the score card, and the types of hand they represent and their pay table 230 values, are a design choice. The examples given above are meant to be illustrative and do not limit the method of the present invention in any way. Other types of hands could include "5 of a Kind" of a certain type (e.g., 4s), hands achieved on certain rolls (e.g., the 1$^{st}$ roll), hands achieved with certain replacements (e.g., Full House replacing one), Chance hands of a certain value (e.g., sum of dice at least 20), and so forth.

Also, the method and timing by which the awards are distributed (e.g., all at once, only upon completion of score card 590, etc.) are also a design choice and the foregoing description is not meant to limit the possibilities.

Finally, in the example shown in FIGS. 7 and 8, the number of hands Z equals the number of entries in the score card. In other words in the example Z=7, there were 7 entries. The present invention is not limited to the value of Z equaling the number of entries. For example, Z could be more than the number of entries 840–850. An example of this would be where Z=10 hands and 7 entries appear in the score card 590. In this alternate version, a player would have three hands, in the player's discretion, where the player is not forced to enter into the score card 590. Such an arrangement improves the player's ultimate payoff. Furthermore, the value of Z could be less than the number of entries. As an illustration of this, Z could be 5 and the player would have to fill in 5 of the 7 entries. Hence, the present invention is not limited to the value of Z equaling the number of entries 840–850 and can be more or less than that value.

In addition, in the preferred embodiment, the player is awarded a bonus value, such as five units, every time a hand is played. In the preferred embodiment, this is a fixed value. It could slide up or slide down with each hand, or simply not be paid. This payment to the player upon playing a hand further encourages the player to stay and play the entire bonus game. It is to be expressly understood that should a player decide to leave the underlying game before the Z hands of the bonus game are played. In that event, the player upon cashing out, the bonus game is reset to start over. The player may or may not be paid for cashing out.

b. Other Alternatives

In another casino game 10 embodiment, after each roll, the player may "hold" any or all of the dice 20 and re-roll the others, but once a die has been "held," it can no longer be replaced. In the example of Table II, the player P has the option of re-rolling any of the five dice 20 even if some of the five dice were held in the prior re-roll. In this alternate embodiment, once dice are held, they are held until the game is completed. This can be typically done by having the dealer D, for example in FIG. 2, place the held dice in a separate area within play area 240 or even in a separate tray, not shown, on table 200.

In an alternate embodiment, additional hand values are allowed, which are not traditional to poker. For example, a hand of "Two Trips" (e.g., 3 Fours and 3 Fives) or a "Chance" hand in which the player may adopt to use the sum of the dice rather than their poker value. The "Chance" hand may be required to have some minimum value.

In an alternate embodiment, replacement is not allowed. Thus, there is no skill involved and the outcome of the roll of X dice is simply compared to a paytable 230.

In an alternate embodiment, the player wagers against the house, and each side develops a hand. The house plays by a fixed set of rules. Once both hands are completed, their respective values are compared to determine the winner. This embodiment may be played one hand at a time or in sets of Z hands at a time.

In an alternate embodiment, the player wagers against another player, and each side develops a hand. Once both hands are completed, their respective values are compared to determine the winner. This embodiment may be played one hand at a time or in sets of Z hands at a time.

In an alternate embodiment, a specific value of the dice (e.g., "one") assumes a wildcard value and substitutes for any other value. For example, a hand of "One-Four-Five-Six" would be considered a Small Straight.

In an alternate embodiment, the results of successive games may be used in the pay table 230. For example, a hand of "5 of a Kind" may be worth 100 units, but if achieved back-to-back might be worth 10,000 units, and so forth.

In an alternate embodiment, the casino game 10 may be tied to a wide area progressive. This may be used in conjunction with the results of successive games (e.g., back-to-back games with a "5 of a Kind" may qualify the player for the progressive amount, etc.).

5. Methods of the Present Invention

In the casino game 10 of the present invention, novel methods for playing a dice game having X dice 20, each of the X dice having F faces 30 with a different symbol thereon so as to form a set {S} of symbols on each of X dice 20 whether the casino game 10 is stand-alone or a bonus game. One of the many methods taught herein for such game, whether on a table or embedded in a computer-based system, comprises the steps of:

(a) placing a wager 260, (In the preferred method, the player places a wager to play the game of the present invention. In other methods, the player plays an underlying game hand wins a game payoff GP which becomes the wager, at the player's option, to play the bonus game of the present invention. In still other methods of the present invention, the wager may be zero or not placed at all and the payoff for the game of the present invention is based upon the playing of an underlying game not the game of the present invention. The funding for the game of the present invention, in these methods, being based upon the overall house advantage of the combined games.)

(b) rolling the set of X dice, (It is to be expressly understood that the dice 20 can be conventionally rolled as shown in FIG. 2 in a play area 240 or that they can be mechanical dice such as illustrated in FIG. 3, or graphic representations of dice in a video screen, not shown. Any equivalent method could be used under the teachings of the present invention to roll the dice. Furthermore, any suitable number can be utilized for X.)

(c) holding none, any, or all of the rolled set of X dice, (The dice can be held in the case of conventionally rolled dice as shown in FIG. 2 by the player simply picking up and re-rolling the selected dice and not the held dice, or the dealer D can set the held dice aside, or a player in the case of mechanical or video dice, shown in FIG. 3, can hold selected ones of the mechanical rolled or video displayed dice 20 by selectively activating buttons 310 or touching a touch-screen video monitor. It is to be expressly understood that any suitable equivalent technique could be used to hold the dice.)

(d) re-rolling the non-held dice in the set of X dice, (As shown in FIG. 2, the player can simply re-roll the non-held dice in area 240 and in the case of the game in FIG. 3, non-held dice can be re-rolled by pushing button 350. It is to be expressly understood that any equivalent method of re-roll of the non-held dice could be utilized under the teachings of the present invention.

(e) repeating steps (c) and (d) Y times to complete a hand, (f) awarding any winning combinations of symbols in the set {S} of X dice when the player holds all dice after a roll or when Y re-rolls have occurred.

Variations on the above method have been presented herein. For example, Z hands can be played wherein upon completion of any hand, an entry can be made into a score card so that at the end of Z hands, the player receives an overall bonus payoff based upon entries from each hand. In addition, the following two versions can be implemented based upon these methods.

a. "Take a Chance on Me"

The "Take a Chance on Me" version of the present invention requires no strategic skill on the part of the player. This version is pure chance. In this version of the method of the present invention X=5, Y=0, =6, {S}={1, 2, 3, 4, 5}. The player places a wager and then engages in a series of rolls of dice 20. The game ends when one of the following hands arises:

TABLE V

| Winning Combination | Payoff |
|---|---|
| 5-of-a-Kind 6s | 1000 |
| 5-of-a-Kind 5s | 500 |
| 5-of-a-Kind 4s | 400 |
| 5-of-a-Kind 3s | 300 |
| 5-of-a-Kind 2s | 200 |
| 5-of-a-Kind 1s | 100 |
| 5-dice Straight | 60 |
| 4-of-a-Kind | 50 |
| Full House | 40 |
| 3-of-a-Kind | 30 |
| 4-dice Straight | 20 |

Upon beginning the bonus game 10, a "bonus multiplier" initiates at 1×. For every roll (of the 5 dice 20) in which Chance is achieved (i.e., none of the above winning combinations in Table V occurs), the bonus multiplier is incremented by 1×. Upon ultimately rolling one of the above hands in Table V, its associated payoff is multiplied by the bonus multiplier to determine the game award.

For example, the game begins with a bonus multiplier of 1×. The first roll is 2-3-4-4-6. Since this is a Chance hand, the multiplier increments to 2×. The next roll is 4-4-5-5-1. Since this is a Chance hand, the multiplier increments to 3×. The next roll is 2-3-4-5-6. Since this is a 5-dice Straight (Large Straight), the game is over. The total award is 3×60=180 units.

The frequencies of each type of hand can be obtained via combinatorial analysis:

TABLE VI

| Combination | Probability |
|---|---|
| 5-of-a-Kind 6s | 1 in 7776 |
| 5-of-a-Kind 5s | 1 in 7776 |
| 5-of-a-Kind 4s | 1 in 7776 |
| 5-of-a-Kind 3s | 1 in 7776 |
| 5-of-a-Kind 2s | 1 in 7776 |
| 5-of-a-Kind 1s | 1 in 7776 |
| 5-dice Straight | 240 in 7776 |
| 4-of-a-Kind | 150 in 7776 |
| Full House | 300 in 7776 |
| 3-of-a-Kind | 1200 in 7776 |
| 4-dice Straight | 960 in 7776 |
| Chance | 4920 in 7776 |

From the above figures, an average value, per game is 87.3 units.

What has been described in this version of the method of the present invention is a method for playing a dice game having X dice, each of the X dice having F faces, and each face F having a unique symbol placed thereon. The dice are then rolled by a player. The method then determines whether a winning combination exists in the rolled X dice. If a winning combination exists in the rolled dice, the multiple value is incremented by one (or any suitable amount) and the dice are re-rolled. On the other hand, if a winning combination exists in the rolled dice, the game ends and the player is awarded a payoff from the payoff table for the winning combination multiplied by the multiple value and the game is over. This game can be played either as a stand-alone game or as discussed above can be initiated when a bonus condition is generated. It is to be expressly understood that the payoff table, the winning combinations, and the payoffs set forth above are only an example and that many variations are possible.

Though the above embodiment has been illustrated with specific pay table values, hand types, and five six-sided dice, other manifestations are possible. The explicit details are meant to be illustrative and not limiting the scope of the invention. Further this version of the method of the present invention can be implemented as a table game, in a gaming machine, as a bonus to a table game, or as a bonus to a gaming machine.

b. "Leave Nothing to Chance"

The "Leave Nothing to Chance" version of the present invention requires skill and potentially results in several hands. In this game, the player plays Z hands of poker dice and tries to avoid obtaining a Chance hand. With proper play, the player has approximately a 6/7 probability of avoiding Chance, hence the game generally lasts several hands. Should the player avoid Chance for 7 successive hands, the player is awarded a 50 unit bonus. Consider the following pay table:

TABLE VII

| Winning Combination | Payoff |
|---|---|
| 5-of-a-Kind 6s | 400 |
| 5-of-a-Kind 5s | 80 |
| 5-of-a-Kind 4s | 70 |
| 5-of-a-Kind 3s | 60 |
| 5-of-a-Kind 2s | 50 |
| 5-of-a-Kind 1s | 40 |
| 4-of-a-Kind | 20 |
| 5-dice Straight | 15 |
| Full House | 12 |
| 3-of-a-Kind | 8 |
| 4-dice Straight | 5 |

The player begins with a win meter of 0. He plays a hand of poker dice (X=5, Y=2, F=6, {S}: {1, 2, 3, 4, 5, 6}). The outcome is compared to the pay table. If the outcome is Chance (i.e., a hand having a combination other than set forth in Table VII), the game is over and the win meter is awarded to the player. Otherwise, the winning combination payoff is added to the win meter.

For example, on the first hand (i.e., Z=1), the player rolls 1-2-4-4-6. The player keeps the 4-4 and re-rolls the other three dice. The new roll is 5-5-5. The player holds all five dice and is credited 12 for a Full House on the win meter. The win meter now reads 12.

On the next hand (i.e., Z=2), the player rolls 1-2-3-4-4. The player keeps the 1-2-3-4 and re-rolls the other die. The new roll is 3. The player re-rolls the odd die again. The new roll is 2. The player is credited 5 for a 4-dice Straight on the win meter, which now shows 17 (i.e., 12+5).

On the next hand (i.e., Z=3), the player rolls 1-2-3-3-2. The player keeps the 3-3 and re-rolls the other three dice. The new roll is 4-4-5. The player keeps the 4-4 and re-rolls the other three dice. The new roll is 2-2-3. The player has Chance, and hence, the game is over. The player is awarded the 17 units on the win meter.

With optimal play, the game is worth approximately 150 units. Though the above embodiment has been illustrated with specific pay table values, hand types, and five six-sided dice, other manifestations are possible. The explicit details are meant to be illustrative and not limiting the scope of the invention. Further this version of the method of the present invention can be implemented as a table game, in a gaming machine, as a bonus to a table game, or as a bonus to a gaming machine.

A method has been presented under this version of the present invention for a player to play a dice game. The player plays a predetermined number Z of hands in the dice game. Each hand has the following steps. The dice are rolled and the player holds none, any, or all of the rolled dice. A hand ends when re-rolling occurs a predetermined number of times or when the dice are all held by a player. If less than all of the dice are held, re-rolling of the dice occurs and the process of re-rolling, as fully described above, occurs a predetermined number Y of times. At the end of a hand, if a winning combination is found in the dice according to a pay table, the corresponding payoff for that winning combination is accumulated in a payoff meter, as discussed above, and the value of Z is incremented by a suitable value such as one. Each hand is played in this fashion. However, the game ends when a predetermined number of Z hands occurs or when a chance hand (i.e., a hand resulting in a rolled dice combination not found in the pay table occurs). When the game ends, the player is awarded based upon the accumulated payoffs. It is to be expressly understood that the payoff table, the winning combinations, and the payoffs set forth above are only an example and that many variations are possible. Again, this version of the game of the present invention can be a stand-alone game either as a table game, in a gaming machine, or as a bonus game in which case the game is initiated when a bonus condition arises from the underlying game.

It is to be expressly understood that while the many versions of the methods of the present invention have been set forth in the above, that these methods can also be implemented in personal computers such as home-based computers or computers located in rooms at a casino or elsewhere in a casino. In which case, all of the computers would be interconnected over a communications network as is commonly done through the Internet or networks in general.

The above disclosure sets forth a number of embodiments of the present invention. Those skilled in this art will however appreciate that other arrangements or embodiments, not precisely set forth, could be practiced under the teachings of the present invention and that the scope of this invention should only be limited by the scope of the following claims.

We claim:

1. A method for playing a casino poker dice game having X dice, each of the X dice having F faces with a different symbol thereon so as to form a set {S} of symbols on each of the X dice, said method comprising the steps of:

(a) placing a wager, (b) rolling the X dice, (c) holding none, any, or all of the rolled dice, (d) ending the casino poker dice game when re-rolling occurs Y times or when all of the rolled dice are held in the aforesaid step, (e) awarding any winning combinations of symbols based on the placed wager and in response to the step of ending the game, (f) re-rolling the non-held dice when less than all the X dice are held, and (g) repeating steps (c) through (f) until the step of ending the casino poker dice game occurs.

2. The method of claim 1 wherein the step of awarding includes the step of determining a payoff from a payoff table, the payoff table having a plurality of winning combinations for the casino poker dice game with each winning combination having an associated payoff value, the payoff value corresponding to the units of the wager.

3. The method of claim 1 wherein the step of ending the casino poker game ends the casino poker dice game when all dice are dice held in response to the step of holding.

4. The method of claim 1 further comprising the step of randomly selecting the value of Y.

5. The method of claim 1 wherein X=5, F=6, {S}={1, 2, 3, 4, 5, 6}, and Y =2.

6. The method of claim 1 wherein the step of paying is based upon at least the following winning combinations of symbols:

| |
|---|
| 5-of-a-Kind 6s on 1st Roll |
| 5-of-a-Kind 5s on 1st Roll |
| 5-of-a-Kind 4s on 1st Roll |
| 5-of-a-Kind 3s on 1st Roll |
| 5-of-a-Kind 2s on 1st Roll |
| 5-of-a-Kind 1s on 1st Roll |
| 5-of-a-Kind where Y = 1 and Y = 2 |
| 5-dice Straight - any roll |
| 4-of-a-Kind - any roll |
| Full House - any roll |
| 3-of-a-Kind - any roll |
| 4-dice Straight - any roll |
| Sum of Dice >= 24 - any roll |
| Sum of Dice < 24 - any roll |

7. The method of claim 1 wherein X=5, F=6 and {S}={A, K, Q, J, 10, 9}.

8. The method of claim 1 wherein X=5, F=6, the set {S}={A, K, Q, J, 10, 9} with each member of {S} a unique suit.

9. The method of claim 1 wherein the value of Y is a function of the wager placed.

10. The method of claim 1 wherein the value of Y is a function of the number of successive casino poker dice games played.

11. The method of claim 1 wherein once a die is held it is permanently held through any subsequent step of re-rolling.

12. The method of claim 1 wherein:

placing a wager by a player occurs in the gaming machine, rolling the X dice occurs in a display on the gaming machine in response to an input signal from the player, holding none, any, or all of the rolled dice occurs in response to hold input signals in the gaming machine from the player, ending the casino poker dice game occurs in the gaming machine when rerolling occurs Y times or when all dice are held in the step of holding, awarding occurs based upon a displayed payoff table in the gaming machine.

13. A method for a player playing a casino poker dice game in a gaming machine, the casino poker dice game having dice, said method comprising:

(a) displaying a payoff table, (b) placing a wager by the player in the gaming machine, (c) rolling the dice in a display on the gaming machine, (d) holding none, any, or all of the rolled dice in response to hold input signals received from the player in the gaming machine, (e) ending the casino poker dice game in the gaming machine when re-rolling occurs a predetermined number of times or when all dice are held in the step of holding, (f) awarding the player any winning combinations in the dice based on the displayed payoff table in response to the step of ending the casino poker dice game, (g) re-rolling the non-held dice in the display on the gaming machine when less than all the dice are held, and (h) repeating steps (d) through (f) in order until the step of ending the casino poker dice game in the gaming machine occurs.

* * * * *